US008615900B2

(12) United States Patent
Diekman

(10) Patent No.: US 8,615,900 B2
(45) Date of Patent: Dec. 31, 2013

(54) FOOTWEAR PROVIDED WITH SPRING MEANS AND AS SUCH SPRING MEANS

(76) Inventor: Johannes Wilhelmus Maria Diekman, 's-Gravenhage (NL)

( * ) Notice: Subject to any disclaimer, the term of this patent is extended or adjusted under 35 U.S.C. 154(b) by 541 days.

(21) Appl. No.: 12/812,865

(22) PCT Filed: Jan. 14, 2009

(86) PCT No.: PCT/NL2009/000004
§ 371 (c)(1),
(2), (4) Date: Oct. 25, 2010

(87) PCT Pub. No.: WO2009/091242
PCT Pub. Date: Jul. 23, 2009

(65) Prior Publication Data

US 2011/0047827 A1 Mar. 3, 2011

(30) Foreign Application Priority Data

Jan. 14, 2008 (NL) ..... 1034913

(51) Int. Cl.
*A43B 13/24* (2006.01)
*A43B 13/18* (2006.01)

(52) U.S. Cl.
USPC ..... 36/27; 36/7.8; 36/38

(58) Field of Classification Search
USPC ..... 36/27, 38, 103, 7.8; D2/946; D21/413
See application file for complete search history.

(56) References Cited

U.S. PATENT DOCUMENTS 2,399,543 A * 4/1946 Dack ..... 36/106
2,447,603 A * 8/1948 Snyder ..... 36/38
3,036,389 A * 5/1962 Wesch ..... 36/7.8
3,044,191 A * 7/1962 Cayo ..... 36/34 R
4,492,046 A * 1/1985 Kosova ..... 36/27
5,138,776 A * 8/1992 Levin ..... 36/38
5,195,258 A * 3/1993 Loader ..... 36/38
5,343,636 A * 9/1994 Sabol ..... 36/7.8
5,871,298 A 2/1999 Lekhtman et al.
6,318,001 B1 11/2001 Lee
6,964,119 B2 * 11/2005 Weaver, III ..... 36/27

FOREIGN PATENT DOCUMENTS

DE 2424889 12/1975
DE 10212541 11/2003

OTHER PUBLICATIONS

International Search Report of PCT/NL2009/00004 dated Apr. 14, 2009.

* cited by examiner

*Primary Examiner* — Jila M Mohandesi
(74) *Attorney, Agent, or Firm* — Rankin, Hill & Clark LLP

(57) ABSTRACT

The invention relates to footwear comprising a sole and an upper, which sole is attached to spring means supported on a ground surface, which spring means comprise at least one U-shaped spring element, which is connected to the sole with a first leg and which is supported on the ground surface with the other leg. A drawback of such footwear is that the spring means are constructed with a certain overmeasure in relation to the footwear so as to generate a certain useful spring effect. Adjusting the spring means of said known footwear is complex and cannot be done efficiently. The object of the invention is to provide improved footwear as referred to in the introduction, as well as improved spring means according to the invention, with on the one hand small constructional dimensions while retaining an advantageous spring effect, which is furthermore easier to adjust. According to the invention, the footwear and also the spring means are characterised in that the free end of the first leg of the U-shaped spring element, has a bent shape and can be accommodated with a proper fit in a correspondingly shaped part of the sole.

8 Claims, 5 Drawing Sheets

FOOTWEAR PROVIDED WITH SPRING MEANS AND AS SUCH SPRING MEANS

The invention relates to footwear comprising a sole and an upper, which sole is attached to spring means supported on a ground surface, which spring means comprise at least one U-shaped spring element, which is connected to the sole with a first leg and which is supported on the ground surface with the other leg.

The invention also relates to spring means and to a sole.

Such footwear is disclosed in German patent publication No. 10212541, for example. A different type of footwear is generally known and marketed under the brand name Kangoo Jump® and via www.kangoojump.com. A drawback of such footwear is that the spring means are constructed with a certain overmeasure in relation to the footwear so as to generate a certain useful spring effect. Adjusting the spring means of said known footwear is complex and cannot be done efficiently.

The object of the invention is to provide improved footwear as referred to in the introduction, as well as improved spring means according to the invention, with on the one hand small constructional dimensions whilst retaining an advantageous spring effect, which is furthermore easier to adjust.

According to the invention, the footwear and also the spring means are characterised in that the free end of the first leg of the U-shaped spring element, has a bent shape and can be accommodated with a proper fit in a correspondingly shaped part of the sole.

The spring effect of the footwear can be adjusted as desired, for example in dependence on the user's weight.

Adjusting or changing the spring behaviour of the U-shaped spring element in dependence on the user can be done in a simple manner in particular in that, according to one embodiment, the bent end of the first leg can be fixed in the correspondingly shaped part of the sole at various positions.

The bent end of the first leg and the correspondingly shaped part of the sole are further provided with several coinciding mounting holes, in which mounting pins can be received.

To realise an effective retainment of the spring element in the sole of the shoe, said correspondingly shaped part of the sole is according to the invention provided with upright side edges. This prevents the spring element from becoming detached undesirably during intensive use (read: jumping).

According to another functional embodiment, the footwear according to the invention is characterised in that said correspondingly shaped part of the sole is provided with clamping means for clamping the free end of the first leg of the U-shaped spring element in place in said part. In this way the spring element is additionally retained, which has a positive effect on the user-friendliness and safety of use of the footwear.

More specifically, said correspondingly shaped part of the sole is to that end provided with at least one pair of flange cams projecting on either side of the retained free end of the first leg of the U-shaped spring element, which flange cams are each provided with a hole, in which a clamping bolt can be received. In this way a useful clamping action is obtained in addition to an effective retainment of the spring element in the sole, which enhances the level of safety during use.

According to an additional embodiment, an improved clamping action by the spring means is realised in that the clamping means further comprise at least one clamping wedge element, which clamping wedge element can be clamped against the free end of the first leg.

More specifically, said clamping wedge element is provided with a bore, in which the clamping bolt can be received.

This makes it possible to realise a more reliable clamping action, wherein more particularly the clamping wedge element is provided with a bevelled contact portion.

In another embodiment, the footwear according to the invention is characterised in that the leg of said one U-shaped spring element that is supported on the ground surface is provided with a protective layer. Said protective layer may function as a sole, for example, which provides a certain measure of grip during use of the footwear provided with said spring means.

The invention also relates to the spring means as defined in the appended claims, of course.

The invention will now be explained in more detail with reference to the drawing, in which.

For a better understanding of the invention, like parts will be indicated by identical numerals in the description of the figures below.

Figure 1:
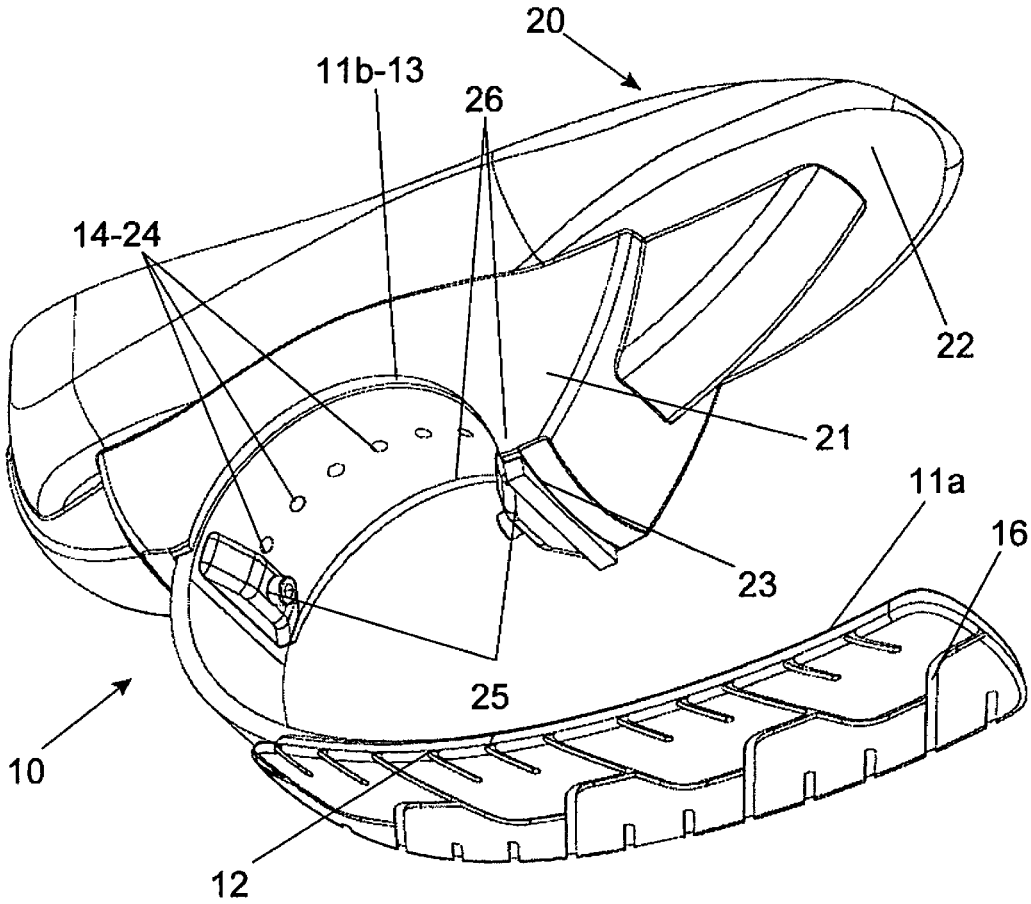
FIG. 1 is a side view of an embodiment of footwear according to the invention.

FIGS. 1-5 shown embodiments of a shoe (or footwear) 20 provided with spring means 10 according to the invention. The shoe 20 comprises a sole 21 and an upper 22. The sole 21 cooperates with a first leg 11*b* of a U-shaped spring element of 10 which forms part of the spring means according to the invention.

The spring means 10 are in principle made up of a U-shaped spring element 10 having two legs 11*a* and 11*b*. The leg 11*a* is supported on the ground surface with its contact surface 12, whilst the other leg 11*b* is connected, to the sole of footwear (not shown) with its contact surface 13. One or more holes 14 are provided in said contact surface 13 for attaching the leg 11*b* to the sole of the footwear, through which holes fixation means 25, such as screws or pop rivets, can be introduced into the sole 21 of the footwear 20.

The use of only the U-shaped spring element 10 provides a spring effect when the footwear air is worn. The construction of the spring element 10 is such that the constructional dimensions can remain within the boundaries of the sole of the footwear. Such a limited construction having small dimensions leads to an improved ergonomic use of the footwear, this in contrast to the current state of the art, which is characterised by spring means having oversized dimensions, which project beyond the sole of the footwear.

A stronger spring effect can be realised by means of the invention, this in contrast to the prior art as referred to in the introduction, which, on account of its specific construction and the materials used, exhibits a significantly smaller rebound spring force. Consequently, a user can walk faster and jump further by using the invention.

Preferably, the U-shaped spring elements 10 and 20 are made of a composite material, in which the spring effect of the two parts can be made to depend on the number of composite layers of which the parts are made. The rigidity, and thus the spring effect of the U-shaped spring elements 10 and 20 can be influenced on the one hand by the material selection (glass fibre, carbon, aramid or another material) and, when a composite is used as the material, by the number of layers of which the spring elements 10 and 20 are built up.

The tread 12 of the leg 11*a* of the spring element 10 may be provided with a protective layer 16, for example a rubber layer, which provides grip and prevents slipping.

Figure 2:
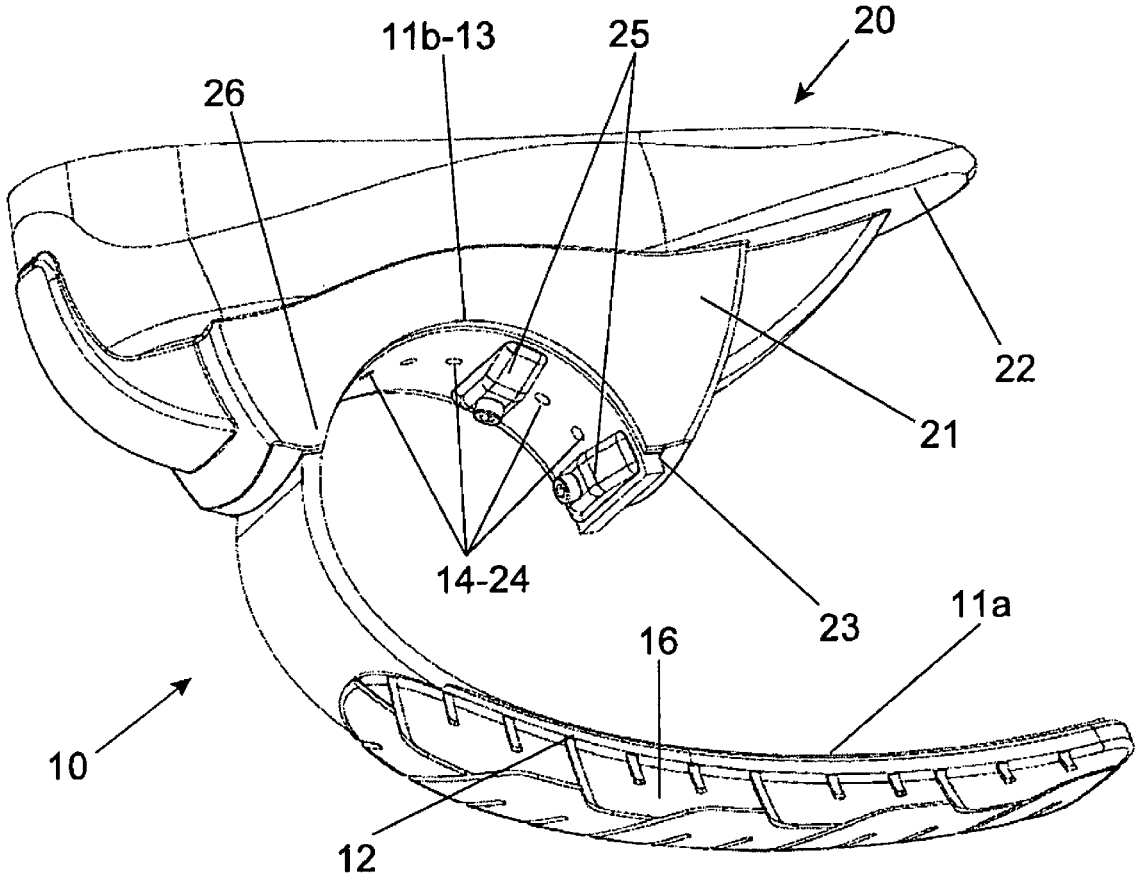
FIG. 2 is a side view of another embodiment of footwear according to the invention.
Figure 3:
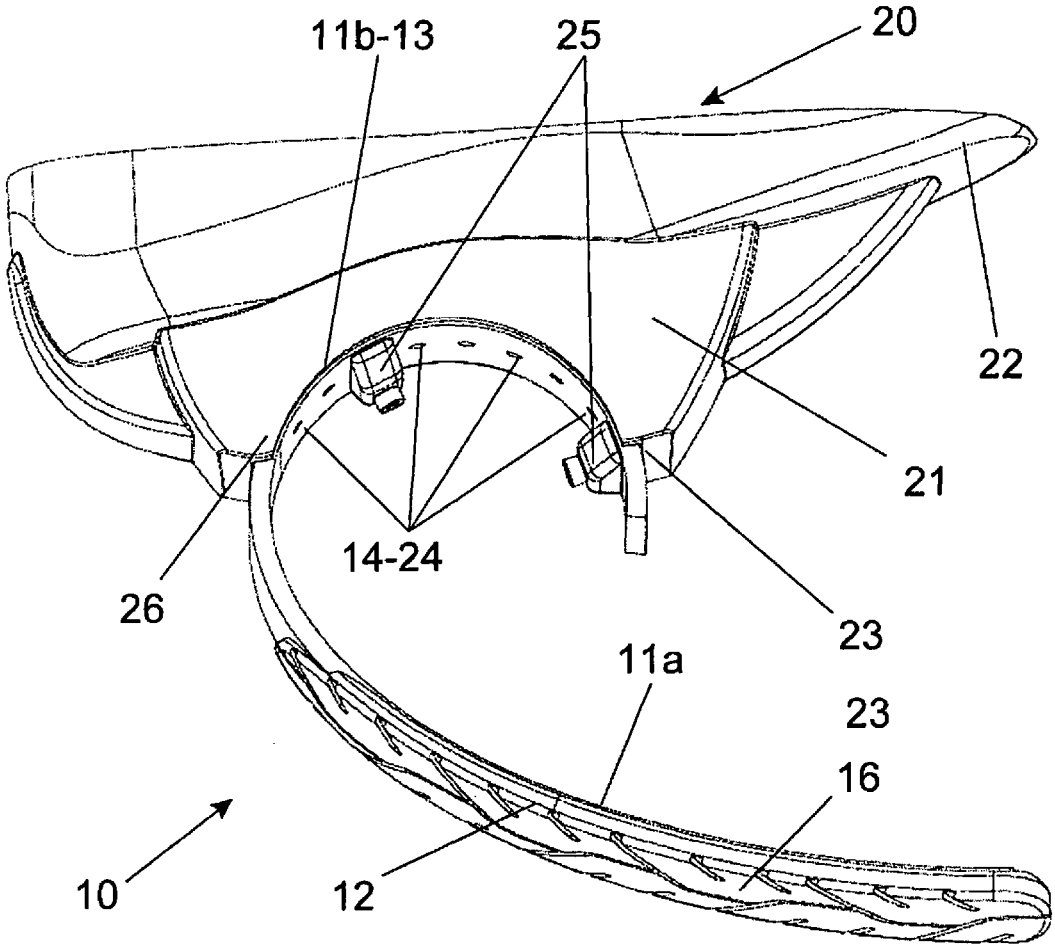
FIG. 3 is a side view of yet another embodiment of footwear according to the invention.

According to the invention and as shown in FIGS. 1-3, the free end of the first leg 11*b* of the U-shaped spring element 10 is bent and can be received with a proper fit in a correspondingly shaped part 23 of the sole 21. The contract surface 13 of the leg 11*b* abuts with a proper fit against said shaped part 23 in that case, which part 23 is provided with upright side edges 26 for adequately accommodating the leg 11*b*, between which side edges the leg 11*b* can be accommodated.

As shown in this embodiment, the bent end of the leg 11*b* is provided with several holes 14, which holes 14 coincide with corresponding mounting holes 24 formed in the shaped part 23 of the sole 21.

This construction of coinciding mounting holes 14-24 makes it possible to place the bent end of the leg 11*b* in the shaped part 23 of the sole 21 in various positions/orientations. The U-shaped spring element can thus be connected to the footwear 20 in said various positions/orientations by means of the mounting pins 25.

FIGS. 1-3 show two key plans, in which the end 11*b* of the U-shaped spring element is connected to the sole 21 at two different positions. FIG. 3 clearly shows that the free end of the leg 11*b* extends beyond the sole 21, in which regard it is further noted that the mounting pins 25 are provided at positions different from those shown in the key plan of FIGS. 1 (and 2).

This makes it possible to adapt the spring effect provided by the U-shaped spring element, depending on, for example, the user's weight, but also depending on the desired spring characteristic of the U-shaped spring element.

In FIG. 1, the U-shaped spring element is connected to the sole 21 of the footwear 20 in such a manner that it exhibits a "weaker" spring characteristic, for example being suitable for people having a low weight. In FIG. 2, the U-shaped spring element is connected to the sole 1 in the same orientation, but the mounting pins 25 are inserted at positions different from those shown in the key plan of FIG. 1. Also the position of the mounting pins 25 contributes to a flexible adjustment of the spring characteristic of the U-shaped spring element.

In FIG. 3, the U-shaped spring element is slightly shifted relative to the sole 21 (compare the key plans of FIGS. 1 and 2), so that a "stiffer" spring characteristic is realised. In this embodiment, the footwear is suitable for people having a higher weight.

Figure 4:
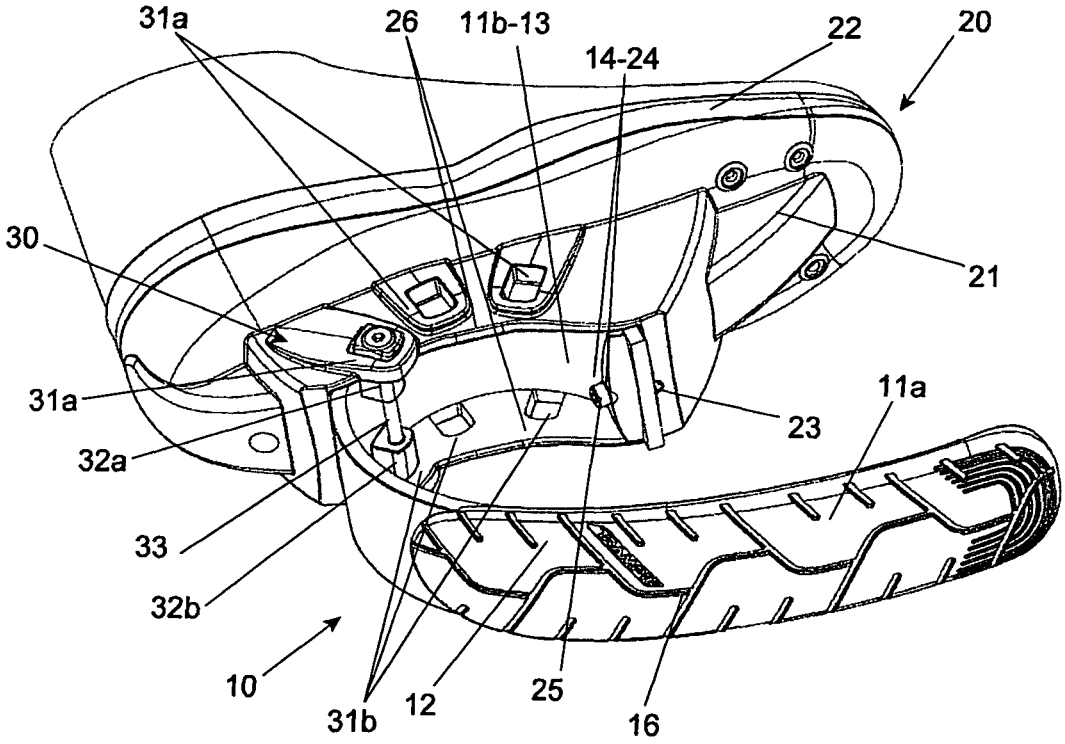
FIGS. 4 and 5 show yet another embodiment of footwear according to the invention.
Figure 5:
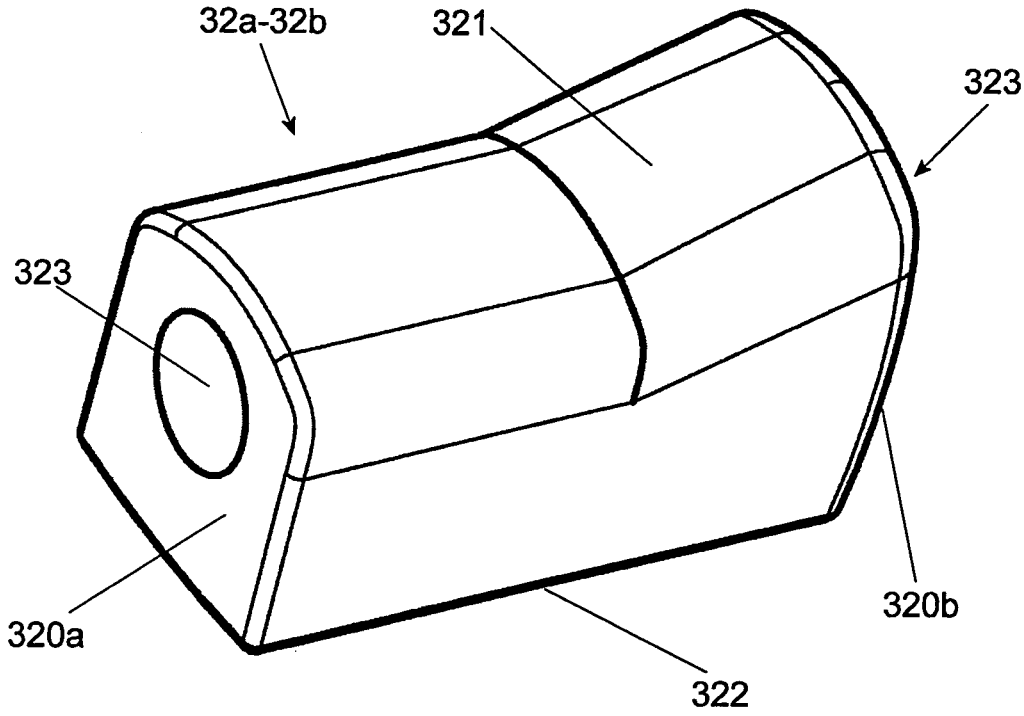

FIGS. 4 and 5 show another embodiment of springing footwear according to the invention. Analogously to the embodiment shown in FIGS. 1-3, the footwear 20 is made up of an upper 22 and a sole 21, the sole 21 comprising a specifically shaped part 23, in which the first leg 11*b* of the spring element 10 can be received.

The bent end of the leg 11*b* is provided with several holes 14 (two in this embodiment), which holes 14 coincide with corresponding mounting holes 24 formed in the shaped part 23 of the sole 21. The mounting principle of the spring element 10 in the shaped part 23 of the sole 21 is the same as the mounting principle in the embodiment shown in FIGS. 1-3.

The embodiment of the footwear shown in FIGS. 4 and 5 is provided with clamping means as additional fasteners for clamping the free end of the first leg 11*b* of the U-shaped spring element 10 in the shaped part 23. In FIG. 4 said clamping means are indicated at 30.

The clamping means 30 are built up of at least two flange parts 31*a*-31*b* projecting on either side of the free end of the first leg 11*b*, through which a clamping bolt 33 can be passed. Each flange element 31*a*-31*b* is to that end provided with a fitting bore, through which the clamping bolt can be passed.

By tightening the clamping bolt 33, the flange elements 31*a*-31*b* are pressed or clamped against the side edge of the free end of the first leg 11*b* of the spring element 10 that is accommodated in the shaped part 23, thereby realising an additional solid fixation, in particular during intensive use (read: jumping). More in particular, the clamping means 30 comprise an additional clamping wedge element 32*a*-32*b*, which can be clamped against the free end of the first leg 11*b* of the spring element 10.

Such a clamping wedge element 32*a*-32*b* is shown in FIG. 5. The clamping wedge element 32*a*-32*b* has a first and a second surface 320*a*-320*b*, a wedge surface 321 and a bottom surface 322. The clamping wedge element 32*a*-32*b* is further provided with a through bore 323 formed through the two first and second end surfaces 320*a*-320*b*. The clamping bolts 33 is to be passed through the bore 323.

Upon tightening the clamping bolt 33, each clamping wedge element 32*a*-32*b* is clamped against the free end of the first leg 11*b*, the more so because each clamping wedge element 32*a*-32*b* has a bevelled contact surface 321.

In this way a more efficient clamping engagement of the spring element 10 in the pre-shaped part 23 of the sole 21 can be realised, thus realising an additional fixation in addition to the fixation principle of several coinciding holes 14 and mounting holes 24. Furthermore it is possible to vary the spring travel by means of said clamping wedge element, which means that the spring system can be adjusted to have a stiffer or weaker spring characteristic.

The invention claimed is:

1. A footwear comprising:

a sole and an upper, the sole is attached to spring means supported on a ground surface, the spring means includes one U-shaped spring element connected to the sole with a first leg and supported on the ground surface with the other leg, wherein a free end of the first leg of the U-shaped spring element has a bent shape and is configured to be accommodated with a proper fit in a correspondingly shaped part of the sole and wherein the free end of the first leg is configured to be fixed in the correspondingly shaped part of the sole at various positions for adjusting or changing the spring behavior of the U-shaped spring element in dependence of the user and wherein the first leg and the correspondingly shaped part of the sole are provided with several coinciding mounting holes for receiving mounting pins.

2. The footwear according to claim 1, wherein the other leg of said one U-shaped spring element that is supported on the ground surface is provided with a protective layer.

3. The footwear according to claim 1, wherein said correspondingly shaped part of the sole is provided with upright side edges.

4. The footwear according to claim 1, further comprising clamping means for clamping the free end of the first leg of the U-shaped spring element in place in said correspondingly shaped part.

5. The footwear according to claim 4, further comprising at least one pair of flange cams projecting on either side of the free end of the first leg of the U-shaped spring element, wherein the flange cams are each provided with a hole for receiving a clamping bolt.

6. The footwear according to claim 4, wherein the clamping means comprise at least one clamping wedge element configured to be clamped against the free end of the first leg.

7. The footwear according to claim 6, wherein said clamping wedge element is provided with a bore for receiving the clamping bolt.

8. The footwear according to claim 6, wherein said clamping wedge element is provided with a beveled contact portion.

* * * * *